United States Patent [19]

Bergeron

[11] Patent Number: 4,907,554

[45] Date of Patent: Mar. 13, 1990

[54] MULTIPLE INTAKE POPPET VALVE ARRAY FOR A SINGLE PORT

[76] Inventor: Charles W. Bergeron, 3841 Crawford Ave., Coconut Grove, Fla. 33133

[21] Appl. No.: 299,987

[22] Filed: Jan. 23, 1989

[51] Int. Cl.[4] ..... F02B 15/00

[52] U.S. Cl. ..... 123/432; 123/90.23

[58] Field of Search ..... 123/90.22, 90.23, 432

[56] References Cited

U.S. PATENT DOCUMENTS

| | | | |
|---|---|---|---|
| 4,617,896 | 10/1986 | Yoshikawa | 123/432 |
| 4,622,940 | 11/1986 | Yoshikawa | 123/432 |
| 4,667,636 | 5/1987 | Oishi et al. | 123/432 |
| 4,765,287 | 8/1988 | Taylor | 123/432 |
| 4,766,866 | 8/1988 | Takii et al. | 123/432 |
| 4,819,591 | 4/1989 | Valentine | 123/90.23 |

*Primary Examiner*—E. Rollins Cross

*Attorney, Agent, or Firm*—Barry L. Haley

[57] ABSTRACT

A multiple intake poppet valve array for use with a single charge carrying intake duct to an engine cylinder in a four cycle internal combustion engine to include three or more annular intake poppet valves and annular valve seats (ports) in fluid communication with said duct and said cylinder for opening and sealing said duct, intake valve lifting and closing means, wherein the area of the duct, the total area of the ports, and the area of the open valves are substantially equal for optimum charge flow at a valve lift distance that occurs earlier and that extends duration when compared with a single poppet valve servicing a similar duct.

8 Claims, 2 Drawing Sheets

MULTIPLE INTAKE POPPET VALVE ARRAY FOR A SINGLE PORT

BACKGROUND OF THE INVENTION

1. Field of the Invention

This invention relates to an intake valve array for use in a four cycle internal combustion engine to increase volumetric efficiency, and specifically to a multiple poppet intake valve array that uses three or more poppet valve bodies for opening and sealing a single intake duct. The sum of the circumferential distances of the valve bodies are specifically determined to achieve optimum lift requirements earlier in the intake valve event, thus extending the duration of optimum valve opening area relative to the duct cross sectional area. The purpose of the invention is to quantitatively increase the duration period of optimum available intake valve open area (circumference times lift) of a single intake duct to enhance optimum charge flow into the combustion chamber during the intake event resulting in greater volumetric efficiency when compared with the duration of maximum valve open area available with one or two conventional intake poppet valves.

2. Description of Related Art

The use of one or two poppet intake valves in a single engine cylinder in a four cycle internal combustion engine is well known in the prior art. Typically each intake duct is serviced by one intake poppet valve. The cross sectional area of the duct and the area of the valve body at maximum lift are generally matched to prevent impedance of the charge velocity when the valve is fully open. Since the correct maximum valve open area is the valve body circumference times maximum lift, conventional valve lift distances exceeding 0.300 inches are employed. Such lift distances encroach the mechanical limits of the cam lobe profile and its valve train components due to time constraints during the intake event. The result is that maximum valve opening is achieved at only one limited instantaneous position over the entire intake event's duration at the cam lobe. This means that during the intake event, the maximum charge available in the intake duct as determined by its cross sectional area is not provided to the cylinder throughout the major portion of the valve event. Increasing the intake valve circumference to reduce lift does not solve the problem because duct enlargement necessary to accommodate the enlarge valve prior to the valve seat area would greatly exceed the upstream duct area creating diffusion, affecting charge velocity consistency throughout the system.

Applicant's invention differs significantly from the conventional intake valve technology in that three or more poppet valves are used for a single duct to increase total valve circumference, reducing valve lift distance required to achieve an extended duration period of maximum available charge flow for a single duct, greatly increasing the volumetric efficiency of the engine.

BRIEF SUMMARY OF THE INVENTION

Three or more annular intake poppet valves are used with a single substantially annular intake duct, the valves providing opening and sealing of the duct within multiple annular ports that open into the engine cylinder. The poppet valves are disposed about the axis of a single port. The diameter of each valve face is predetermined in size such that the sum total of the circumferential distances of the poppet valves exceeds the circumference of the duct by at least a factor of 1.4 or more, reducing maximum valve lift distance required to match or approximate duct cross sectional area. However, in area, the sum total of the valve array generally maintains equality to the area of the duct. The single duct transitions into an interface of multiple ports (branching) opening into the engine cylinder to accommodate the multiple valve seats and the respective ports for the multiple poppet valve array, ensuring that the duct cross sectional area, when compared with the sum total of the multiple valve seat port areas, is generally equal in order to prevent charge flow impedance or diffusion.

Each of the valves in the array is opened and closed in a conventional manner using spring tension and a cam and cam lobes. However with the present invention, the duration of maximum charge flowability, the time period during valve and seat separation in which valve impedance of flow becomes ineffectual to duct flow until closure of the valve impedes flow, is greatly enhanced because of the increased valve circumference available. In addition, reduced lift requirements in combination with the valve array achieve maximum duct charge flowability earlier in the valve event. Lower optimum valve lift requirements result in the valve array reaching their optimum lift position earlier during acceleration upon a conventional cam profile resulting in an extended duration of optimum valve open area (circumference times lift) during the intake event.

Therefore, the important benefits of this invention occur because of the extended time of maximum flowability available for the intake charge flow into the engine cylinder from a single duct, thus allowing for greater volumetric efficiency achievement during the intake event, while at the same time maintaining the necessary predetermined available area for flow through the ports into the engine cylinder. By increasing the available valve circumferential distance, the required maximum lift distance for each valve can be reduced while improved per unit time optimum flow into the engine cylinder occurs. In practice, an earlier achievement of optimum valve opening allows for an extended duration of optimum charge flowability to occur, whereas combined interaction of the poppet valve array, cam profile, and multiple valve circumferences result in improved charge flow/volume by way of increased charge expurgation between the poppet valve array bodies and their respective seats per unit time of engine operation for induction of charge, thus quantitatively improving volumetric efficiency.

There are three stages in the charge flow induction path that significantly affect the velocity and volume per unit time of charge flow through to the engine cylinder, namely the cross sectional area of the duct, the total areas of the ports defined by the valve seats, and the total areas defined by the valves at lift positions during the valve event (circumference times valve lift). In the present invention, the use of multiple poppet valves for a single duct allows the physical dimensions of the duct diameter and area, the valve diameters and seat areas, and the valve circumferences times lift (valve open areas) to be optimized to minimize charge flow impedance for an increased duration period.

It is an object of this invention to provide an intake valve array for use with each single intake duct in a four cycle internal combustion engine to improve volumetric efficiency in a four cycle internal combustion engine.

It is another object of this invention to provide a multiple intake valve array for use with each single intake duct which permits early achievement of optimum flowability capability prior to the significant period of piston velocity.

It is another object of this invention to provide a multiple intake valve array for each single intake duct for a four cycle internal combustion engine which permits increased duration of optimum flowability at optimum valve open area during the significant period of piston velocity of the intake cycle to improve the volumetric efficiency of the engine.

Another object of this invention is to provide an intake valve array that allows the engine designer to improve particular cam lobe parameters such as to open the intake valve array later as compared to conventional valve opening requirements, thus resulting in improved charge filling without charge cross over (overlap).

And yet another object of this invention is to provide a valve array for use in an internal combustion engine which may also function during the exhaust cycle as an exhaust valve array.

In accordance with these and other objects which will be apparent hereinafter, the present invention will now be described with particular reference to the accompanying drawings.

PREFERRED EMBODIMENT OF THE INVENTION

In the preferred embodiment, four intake poppet valves are symetrically disposed about the axis of a single duct.

Figure 1:
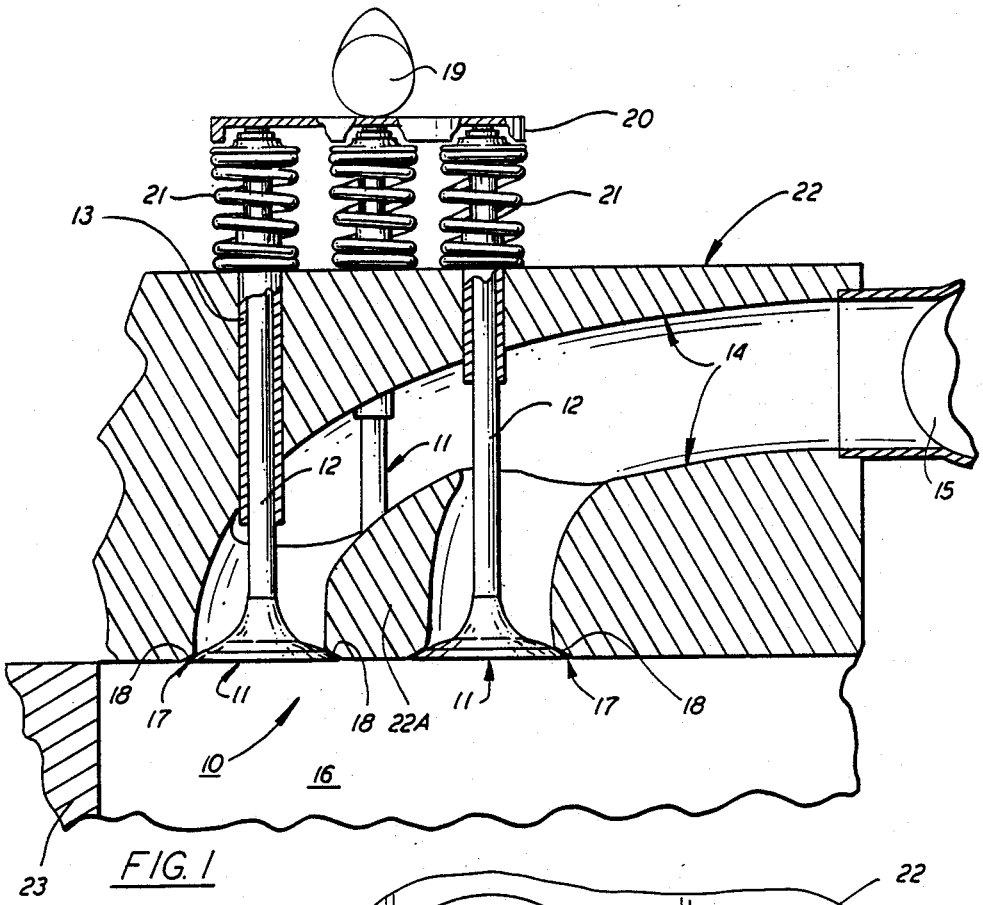
FIG. 1 is a side elevational view in cross section showing a preferred embodiment of the invention.

Referring now to FIG. 1, the invention is shown generally at 10 comprised of four intake poppet valves 11 having stems 12 connected through valve guides 13, each of said valves 11 being disposed in fluid communication with the single intake duct 14 which leads from the charge source 15 to the engine cylinder 16. The inlet ports 17 to the engine cylinder 16 includes a wall surface 18 that houses a valve seat for each of the valves 11.

Each of the valves 11 is opened through a cam 19 pushing disk 20 that is in communication with each of the valves stems 12. The valves 11 are sealed shut by the action of springs 21 connected to each valve stem 12 in a conventional manner. The cylinder head 22 is connected to engine block 23 that houses the engine cylinder 16. A poppet exhaust valve (not shown) would communicate with the engine cylinder 16 in a conventional manner.

The area of the intake duct 14 is predetermined in size such that the combined total area of the ports 17 are substantially equal to the cross sectional area of the duct 14. With multiple equal area valves 11 (three or more), the circumferential distance of the sum total of the valves 11 and therefore the ports 17 is generally 1.4 or more times the circumference of a single valve conventionally used across a single port opening in the cylinder head. The preferred embodiment utilizes four poppet intake valves 11 as shown in FIG. 1 wherein each valve diameter is determined in size relative to the diameter of the duct 14 to achieve comparable seat area to duct area and valve open area (circumference times lift). A tapered somewhat conical wall segment 22A is employed in the region of transition of the charge flow into the ports 17.

Figure 3:
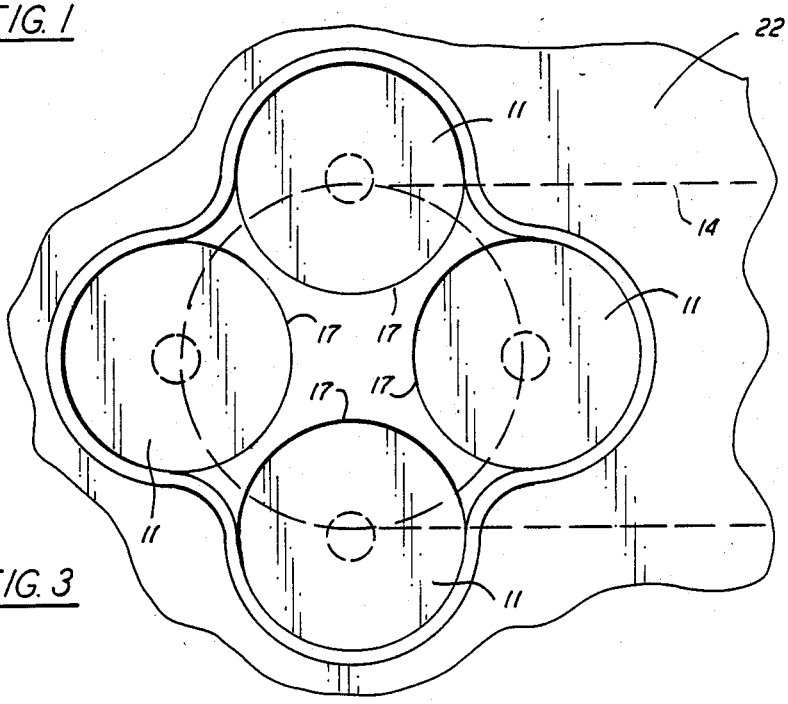
FIG. 3 is a bottom plan view of the invention.
Figure 2:
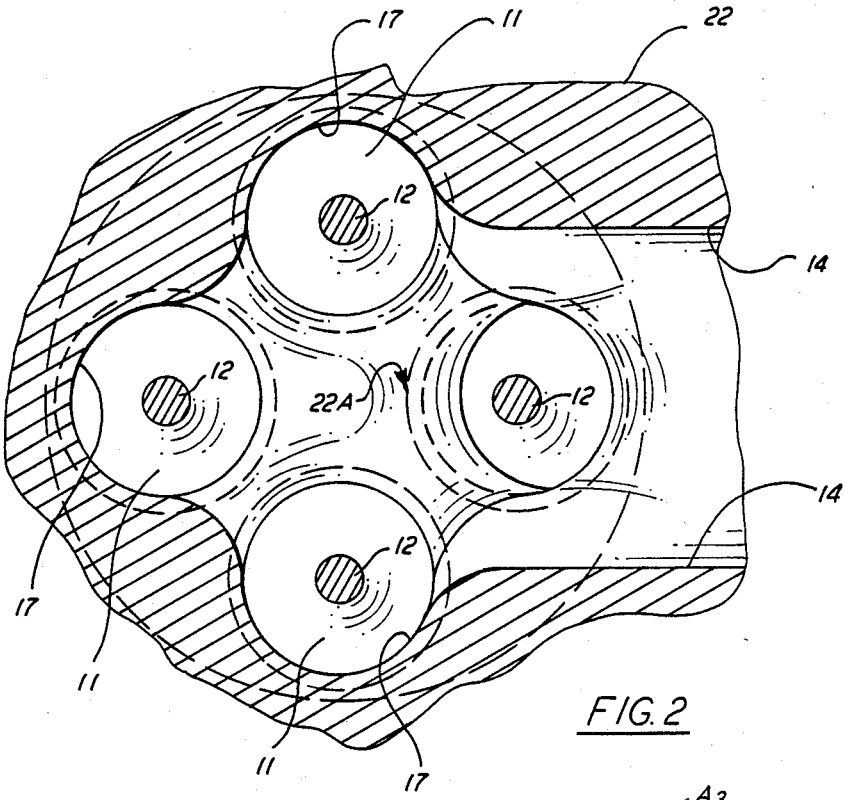
FIG. 2 is a top plan view in cross section showing the invention.

FIGS. 1, 2 and 3 show the relationship and location of the valves 11 relative to the intake duct 14 diameter as previously described. Note that the valve stems 12 are disposed symetrically about the center axis of the duct 14 in the preferred embodiment, with the valve stems 12 being substantially near the perimeter wall of the duct 14.

Each port 17 within cylinder head 22 includes a valve seat 18 for each poppet valve 11 to ensure the proper seal across the ports. The cylinder head body 22 provides the seating surfaces 18 for the poppet valves 11. In the preferred embodiment the ports 17 would be cast with the cylinder head 22. However the duct 14 opening could also be constructed using a plate having the port apertures and seats and which would be inserted across the duct opening (with or without segment 22A).

Figure 4A:
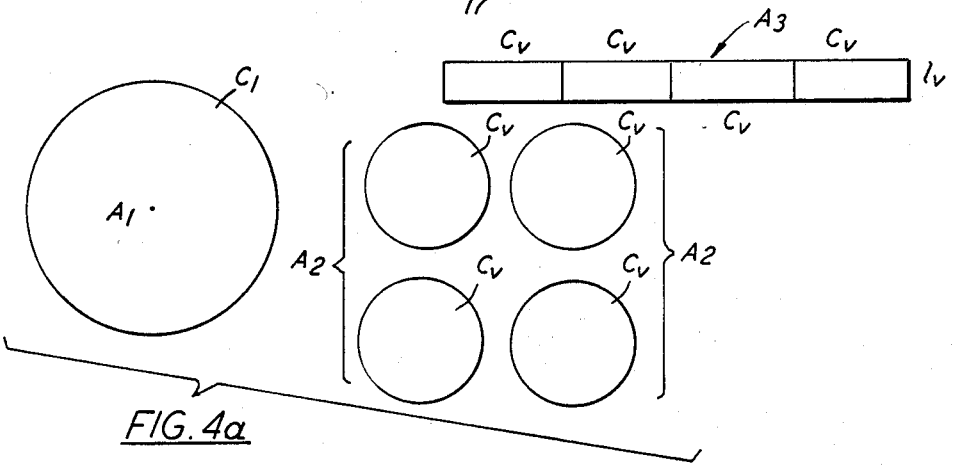
FIGS. 4*a* and 4*b* are diagrams with geometrical figures useful in discussing certain relative dimensions employed in the invention.
Figure 4B:
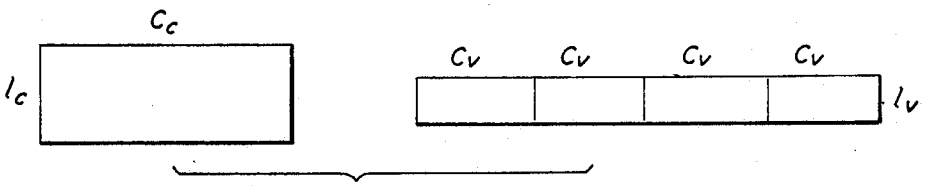

FIGS. 4*a* and 4*b* show a diagram having geometrical figures in order to compare the valve open areas (circumferences times lift) to the duct area and the port (seat) areas. In Applicant's invention, the area A1 of the duct is generally equal to the total areas of the ports A2 and the area of the open valves A3 at optimum lift. FIG. 4b shows a comparison of the lift distance 1c required for a single valve with circumference Cc to achieve the same open area as four valves having circumferences Cv and a greatly reduced lift distance lv.

Comparing the area A1 of the duct 14 and the total areas A2 of the valves 11 with that of a single valve also having area A1 across a single port opening, it is readily seen that when using four valves (the circumference of each valve multiplied by the lift distance), the lift distance necessary for optimum area of available charge flow into the engine cylinder will be greatly reduced when compared to a conventional single valve servicing the single intake duct 14. This results in a greater volumetric efficiency of the engine because the valve lift distances are reduced so that the valves are at the optimum open position required to match duct flowability for a longer time (duration period) during the intake event. The duct area, the total multiple port (seat) areas, and the optimum valve open areas are comparable in size maintaining constant velocity and interfluent consistency resulting in high charge flow velocity, while the duration of optimum charge flow area results in greater charge flow volume into the cylinder during the intake event.

In theory and without considering practical variables such as drag coefficient, it can be shown mathematically that using three valves of equal area having a total area equal to a duct cross section area will result in a 0.57 lift distance required for optimum area (that is when the valve lift area equals the duct area) compared to the lift distance required with a single valve servicing the same duct. With four equal area valves, the lift distance is 0.50 of the required distance of a single valve. In general, the lift distance required with multiple valves to maintain area consistency when compared with a single valve is the reciprocal of the square root of the number of equal area valves employed. In a practical design, many variables must be considered including velocity and drag coeficients to match the areas for the desired duct optimum flowability.

For example, in theory if the duct diameter is 1.625 inches, with one valve the required lift distance to achieve equal valve open area is 400 inches. With four valves, each having a radius of 406 inches, the lift required to achieve equal valve open area is 0.200 inches. This means that when the four valves reach 0.200 inches lift, they are providing an open area that equals the duct area, the theoretical optimum. Because the four valves reach 0.200 inches lift much earlier in the intake cycle than a single valve reaches 0.400 inches, duration at optimum area/flow is considerably longer with four valves resulting in improved volumetric efficiency.

In the manufacture of the cylinder head housing the intake ducts, the multiple ports for each duct can be molded in a conventional way or using a existent cylinder head, a plate like member having the port or partial port openings can be affixed across each duct opening.

Although an overhead valve engine has been shown, the invention can also be used with other intake poppet valve engine designs such as the valve in block design.

It should be noted that the multiple valves may be opened in unison or sequentially.

It will be apparent to those skilled in the art that various modifications could be made in the present invention without departing from the scope or spirit of the invention. For example, the dimensions discussed herein may be varied with a concommitent reduction in performance.

What I claim is:

1. A multiple poppet valve array for use with a single intake duct in a four cycle internal combustion engine comprising:

three or more poppet valves;

an engine cylinder;

a cylinder head having at least one intake duct in fluid communication with said combustion chamber, said intake duct having three or more apertures opening into said engine cylinder, said apertures including poppet valve seats about their perimeter for seating said three or more poppet valves, the total aperture area substantially matching the cross sectional area of said single intake duct, sized as to complement the charge flow characteristics of said duct, the sum of the circumferences of the multiple valve bodies being greater than the duct circumference by a factor of 1.4 or more; and means for opening and closing each of said poppet valves in communication with said poppet valves.

2. A multiple poppet valve array as in claim 1, wherein: the area of each poppet valve body and each respective aperture at the centerline of the seat is equal to each other.

3. A multiple poppet valve array as in claim 1, wherein:

said number of poppet valves and apertures is four.

4. A multiple poppet valve array as in claim 3, wherein:

the intake duct circumference is one-half the total circumferences of the valve bodies.

5. A multiple poppet valve system for use with a single intake duct in a four cycle combustion engine comprising:

three or more intake poppet valves;

an engine cylinder;

a cylinder head body having a single intake duct for transporting charge and three or more ports in fluid communication with said single duct and said engine cylinder, the cross sectional area of the intake duct being generally equal to the total area of said ports;

means for lifting and closing said valves in communication with said valves, said lifting means being sized to a lift distance at least to optimize duration during the intake event whereby the total valve open area is generally equal to the total port area.

6. A multiple valve system as in claim 5, wherein:

the circumferences of the valves exceeds the circumference of the duct by a factor of 1.4 or more.

7. A multiple valve system as in claim 5, wherein:

four valves and four ports are employed.

8. A multiple valve system as in claim 5, wherein:

the valve lift requirement for optimum flow and duration when compared with a single valve servicing said duct is reduced by a factor that equals the reciprocal of the square root of the number of valves employed.

* * * * *